US010184729B2

(12) United States Patent
Inagaki et al.

(10) Patent No.: US 10,184,729 B2
(45) Date of Patent: Jan. 22, 2019

(54) HEAT PIPE

(71) Applicant: Furukawa Electric Co., Ltd., Tokyo (JP)

(72) Inventors: Yoshikatsu Inagaki, Tokyo (JP); Kenya Kawabata, Tokyo (JP); Tatsuro Miura, Tokyo (JP); Tomoki Yanagida, Kanagawa (JP)

(73) Assignee: FURUKAWA ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/586,419

(22) Filed: May 4, 2017

(65) Prior Publication Data

US 2017/0234625 A1 Aug. 17, 2017

Related U.S. Application Data

(63) Continuation of application No. PCT/JP2015/082173, filed on Nov. 17, 2015.

(30) Foreign Application Priority Data

Nov. 17, 2014 (JP) ..... 2014-232381

(51) Int. Cl.
*F28D 15/04* (2006.01)
*F28F 1/08* (2006.01)
(Continued)

(52) U.S. Cl.
CPC ..... *F28D 15/046* (2013.01); *F28D 15/0233* (2013.01); *F28D 15/0241* (2013.01);
(Continued)

(58) Field of Classification Search
CPC ..... F28D 15/046; F28D 15/0275
(Continued)

(56) References Cited

U.S. PATENT DOCUMENTS 3,913,665 A * 10/1975 Franklin et al. ..... 165/104.26
4,953,632 A * 9/1990 Sakaya et al.
(Continued)

FOREIGN PATENT DOCUMENTS

JP S57-169598 A 10/1982
JP S58-55687 A 4/1983
(Continued)

OTHER PUBLICATIONS

Chinese Notification of Grant Utility Model Patent Right dated Dec. 4, 2017 for corresponding Chinese utility model application No. 201590001035.5 and English translation.
(Continued)

*Primary Examiner* — Allen Flanigan
(74) *Attorney, Agent, or Firm* — Pearne & Gordon LLP

(57) ABSTRACT

A heat pipe includes a container in which a corrugated portion is formed, the container having a hollow portion formed therein that is sealed, a wick structure provided on an inner peripheral surface of the hollow portion and a working fluid enclosed in the hollow portion. The wick structure has a vapor channel penetrating therethrough in a longitudinal direction of the hollow portion, the wick structure producing a capillary force. The wick structure is a sintered body of a powder metal material and projected into a crest portion of the corrugated portion. The wick structure is provided at a region in the crest portion of the corrugated portion and at a position of a trough portion of the corrugated portion.

5 Claims, 10 Drawing Sheets

(51) Int. Cl.
*F28D 15/02* (2006.01)
*F28D 21/00* (2006.01)

(52) U.S. Cl.
CPC ..... *F28D 15/04* (2013.01); *F28F 1/08* (2013.01); *F28D 2021/0028* (2013.01); *F28F 2255/18* (2013.01)

(58) Field of Classification Search
USPC ..... 165/104.26; 361/700
See application file for complete search history.

(56) References Cited

U.S. PATENT DOCUMENTS

| | | | | |
|---|---|---|---|---|
| 6,070,654 | A * | 6/2000 | Ito | |
| 8,069,907 | B2 * | 12/2011 | Bryant et al. | 165/46 |
| 2004/0037039 | A1 * | 2/2004 | Shimura et al. | 361/700 |
| 2005/0180109 | A1 * | 8/2005 | Miyazaki et al. | 361/700 |
| 2006/0086482 | A1 * | 4/2006 | Thayer et al. | 165/104.26 |

FOREIGN PATENT DOCUMENTS

| | | | |
|---|---|---|---|
| JP | 58-088593 | A | 5/1983 |
| JP | 58-110993 | A | 7/1983 |
| JP | S58-110991 | A | 7/1983 |
| JP | S58-110992 | A | 7/1983 |
| JP | 59-215592 | A | 12/1984 |
| JP | S61-181967 | U1 | 11/1986 |
| JP | S62-66097 | A | 3/1987 |
| JP | S63-126778 | U1 | 8/1988 |
| JP | H01-273993 | A | 11/1989 |
| JP | 03-22815 | A | 1/1991 |
| JP | 06-012371 | Y | 3/1994 |
| JP | H10-91823 | A | 4/1998 |
| JP | H11-287577 | A | 10/1999 |
| JP | 2000-274972 | A | 10/2000 |
| JP | 2002-022381 | A | 1/2002 |
| JP | 2004-198096 | A | 7/2004 |
| JP | 2007-056302 | A | 3/2007 |
| JP | 2008-241180 | A | 10/2008 |
| JP | 2014-052110 | A | 3/2014 |
| KR | 2002-0077696 | A | 4/2015 |
| TW | M372460 | U1 | 1/2010 |
| WO | WO 0244639 | A1 * | 6/2002 |

OTHER PUBLICATIONS

Japanese Office Action dated Jan. 19, 2015 for corresponding Japanese Application No. 2014-232381 and English translation.
Japanese Decision to Grant Patent dated Jun. 29, 2015 in corresponding Japanese Application No. 2014-232381.
English Translation of Written Opinion from Corresponding Application No. PCT/JP2015/082173; dated Feb. 16, 2016.
International Preliminary Report on Patentability from Corresponding Application No. PCT/JP2015/082173; dated May 23, 2017.
International Search Report and Written Opinion from Corresponding Application No. PCT/JP2015/082173; dated Feb. 16, 2016.
Office Action from Corresponding Application No. TW104137820; dated Dec. 1, 2016.
Approval Decision Letter in Corresponding Application No. TW104137820; dated Apr. 21, 2017.
Korean Office Action dated Jul. 13, 2018 for corresponding Korean Application No. 10-2017-7010531 and English translation.

* cited by examiner

ONE END PORTION

CENTRAL PORTION

OTHER END PORTION

ONE END PORTION

CENTRAL PORTION

OTHER END PORTION

ONE END PORTION

CENTRAL PORTION

OTHER END PORTION

HEAT PIPE

CROSS REFERENCE TO RELATED APPLICATIONS

This is a continuation application of International Patent Application No. PCT/JP2015/082173 filed Nov. 17, 2015, which claims the benefit of Japanese Patent Application No. 2014-232381, filed Nov. 17, 2014, the full contents of all of which are hereby incorporated by reference in their entirety.

BACKGROUND

Technical Field

The present disclosure relates to a heat pipe that transports heat input from outside as latent heat of a working fluid, and that has deformability and also a property that the deformed shape can be maintained.

Background

Electronic components such as semiconductor devices installed in electric/electronic devices produce an increased amount of heat due to high density packaging or the like along with improvement in functionality, and importance of cooling of such electronic components is increasing recently. Heating elements such as electronic components may be cooled using heat pipes, since heat pipes have good heat transportation capability.

When a heating element is installed in a small space or a plurality of heating elements are packaged at a high density, it is necessary to bend a heat pipe for thermally connecting the heat pipe with a heating element. However, a conventional heat pipe has poor deformability, such as bending, and thus cannot be thermally connected to the above-mentioned heating element sufficiently.

Accordingly, recently, there is a need for a heat pipe having improved characteristics such as bending or twisting. Thus, a heat pipe has been proposed which comprises a sealed pipe having helical ribs and grooves in a corrugated form with deep grooves formed on an outer perimeter side and parallel to a radial direction and thin grooves formed on an inner perimeter side to produce a capillary action, and easily bends and deforms by the deep grooves, and after the deformation, does not naturally restore immediately and maintains a deformed configuration, and also causes the working fluid to circulate due the capillary action produced by the thin grooves. (See Japanese Laid-Open Patent Publication No. H11-287577).

However, since the heat pipe of Japanese Laid-Open Patent Publication No. H11-287577 causes the working fluid to flow back by a capillary force of the thin grooves of the helical ribs and grooves in a corrugated form, the working fluid does not flow back sufficiently, and thus the heat transportation capability of the heat pipe decreases. Also, with the heat pipe of Japanese Laid-Open Patent Publication No. H11-287577, since the channel of a working fluid in a liquid phase and the channel of a working fluid in a gas phase are not sufficiently partitioned, a drag is produced between a flow of the working fluid in a liquid phase and a flow of the working fluid in a gas phase that are opposite flows. This also causes a decrease in the heat transportation capability of the heat pipe. Therefore, it is difficult to use the heat pipe of Japanese Laid-Open Patent Publication No. H11-287577 in a top heat mode.

The present disclosure is related to providing a heat pipe that has an improved property of easily undergoing deformation such as bending and twisting and maintaining the deformed shape as well as an improved heat transportation capability.

SUMMARY

According to an aspect of the present disclosure, a heat pipe includes a container in which a corrugated portion is formed, the container having a hollow portion formed therein that is sealed, a wick structure provided on an inner peripheral surface of the hollow portion, the wick structure having a vapor channel penetrating therethrough in a longitudinal direction of the hollow portion, the wick structure producing a capillary force, and a working fluid enclosed in the hollow portion, a gap portion being formed between the wick structure and a crest portion of the corrugated portion.

With the aspect of the present disclosure described above, the corrugated portion is formed by deforming a wall surface of the container to process the wall surface into a corrugated shape. Since an inner surface of the wall surface of the container processed into a corrugated shape forms a hollow portion, the corrugated portion is also formed on an inner peripheral surface of the hollow portion.

With the aspect of the present disclosure described above, when heat from an outside heat source (heating element) is received at a heat input portion which is one end portion of the heat pipe, the working fluid in a liquid phase vaporizes at the heat input portion, and the heat from the heat source transfers as latent heat to the working fluid. Since an inside of the heat pipe, namely the hollow portion, is deaerated, vapor of the working fluid vaporized at the heat input portion, namely the working fluid in the gas phase flows from the heat input portion to the heat output portion that is the other end portion of the heat pipe, not only via a vapor channel of the wick structure penetrating therethrough in a longitudinal direction of the hollow portion but also a gap portion formed between the wick structure and a crest portion of the corrugated portion. The vapor of the working fluid which has flowed to the heat output portion condenses at the heat output portion and releases latent heat. The latent heat released at the heat output portion is released from the heat output portion to an external environment of the heat pipe. The working fluid that has condensed at the heat output portion and turned into a liquid-form is returned from the heat output portion to the heat input portion by a capillary force of the wick structure.

According to another aspect of the present disclosure, a heat pipe includes a container in which a corrugated portion is formed, the container having a hollow portion formed therein that is sealed, a wick structure provided on an inner peripheral surface of the hollow portion, the wick structure having a vapor channel penetrating therethrough in a longitudinal direction of the hollow portion, the wick structure producing a capillary force, the wick structure being projected into a crest portion of the corrugated portion, and a working fluid enclosed in the hollow portion.

Herein, the "corrugated portion" includes a crest portion that is a portion protruding when viewed from an outside of the heat pipe, and a trough portion that is a portion recessed with respect to the crest portion.

Preferably, with the heat pipe of the above aspect, a flattening process is applied to the container at a part or an entirety thereof in a longitudinal direction. The flattening process may be applied at a portion where the corrugated portion is formed, at a portion where the corrugated portion is not formed, or even at both of these portions.

Preferably, with the heat pipe of the above aspect, the corrugated portion is formed in the container at a part or an entirety thereof in a longitudinal direction. Further, preferably, the corrugated portion has a helical shape.

Preferably, with the heat pipe of the above aspect, the wick structure is a metal mesh. Further, preferably, with the heat pipe of the above aspect, the wick structure is a sintered body of a powder metal material.

According to the present disclosure, since a container is provided with a corrugated portion, the heat pipe has a property of easily undergoing deformation such as bending and twisting and maintaining the deformed shape. Thus, since the heat pipe of the present disclosure is superior in the aforementioned property, even if a heating element is installed in a small space or a plurality of heating elements are packaged at a high density, thermal connection with a heating element, which is an element to be cooled, can be ensured by applying deformation such as bending to the heat pipe. Also, according to the present disclosure, since vibration and impact on the heat pipe can be absorbed by a corrugated portion, the heat pipe can be prevented from being damaged or detached, even if the heat pipe is installed at a portion subjected to vibration or impact.

According to the present disclosure, a wick structure having a vapor channel penetrating in a longitudinal direction of a hollow portion is installed at an inner peripheral surface of the hollow portion, and further, a gap portion is formed between the wick structure and the crest portion of the corrugated portion, and the working fluid in a gas phase flows from the heat input portion to the heat output portion in the vapor channel and in the gap portion, and the working fluid in the liquid phase flows from the heat output portion to the heat input portion in the wick structure, the channel of the working fluid in a gas phase and the channel of the working fluid in a liquid phase can be surely separated. As a result, a good heat transportation efficiency can be achieved.

Also, according to the present disclosure, since the gap portion formed between the wick structure and the crest portion of the corrugated portion is a channel of the working fluid in a gas phase, and the working fluid in the liquid phase can be prevented from flowing into the gap portion, the crest portion of the corrugated portion also has an improved heat production capability, and a heat dissipating efficiency of the heat pipe improves.

According to the present disclosure, since the wick structure is also provided at a region in the crest portion of the corrugated portion, a capillary force of the wick structure further improves, and also, due to the corrugated portion, a surface area is increased in comparison to a container with only a smooth surface, and a heat dissipating effect further improves. Also, according to an aspect of the present disclosure, in a case where a void portion exists in a wick structure formed in the crest portion of the corrugated portion, namely, in a case where a void portion exists inside the wick structure formed in the crest portion of the corrugated portion or between the wick structure formed in the crest portion, a capillary force further improves by the wick structure in the crest portion, and also since the void portion has a similar function as the gap portion, the crest portion of the corrugated portion has a superior heat dissipation capability.

According to the present disclosure, since a flattening process is applied to a part or all of the container in the longitudinal direction, thermal connectivity with the heating element further improves, and a cooling capacity of the heat pipe further increases. Further, with the flattening process described above, a heat pipe can be arranged in a smaller space. Further, by applying a flattening process to a heat input side end portion and a heat output side end portion, a contact area with the heating element increases at the heat input portion and pressure loss of the cooling air can be reduced at the heat output portion.

DETAILED DESCRIPTION

Figure 1:
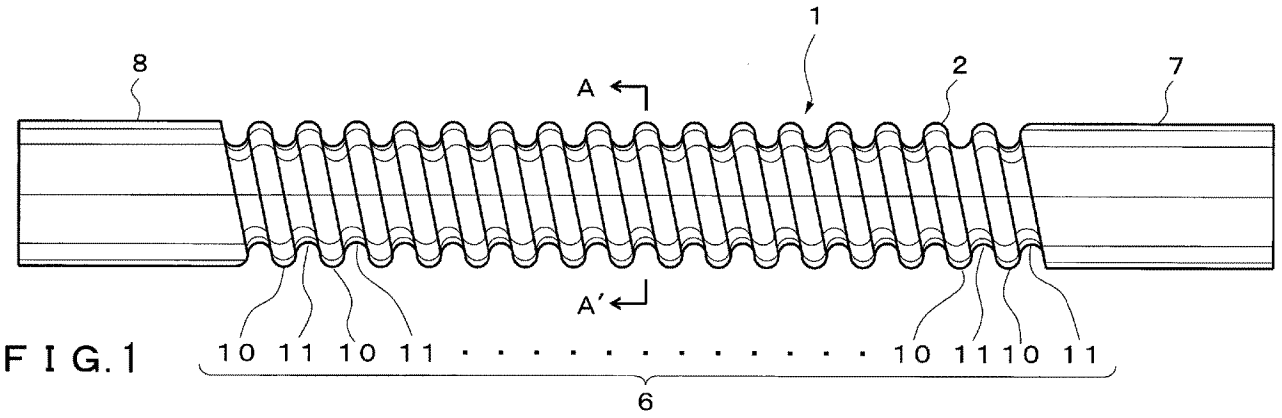
FIG. 1 is a side view showing a heat pipe according to a first embodiment of the present disclosure.
Figure 2:
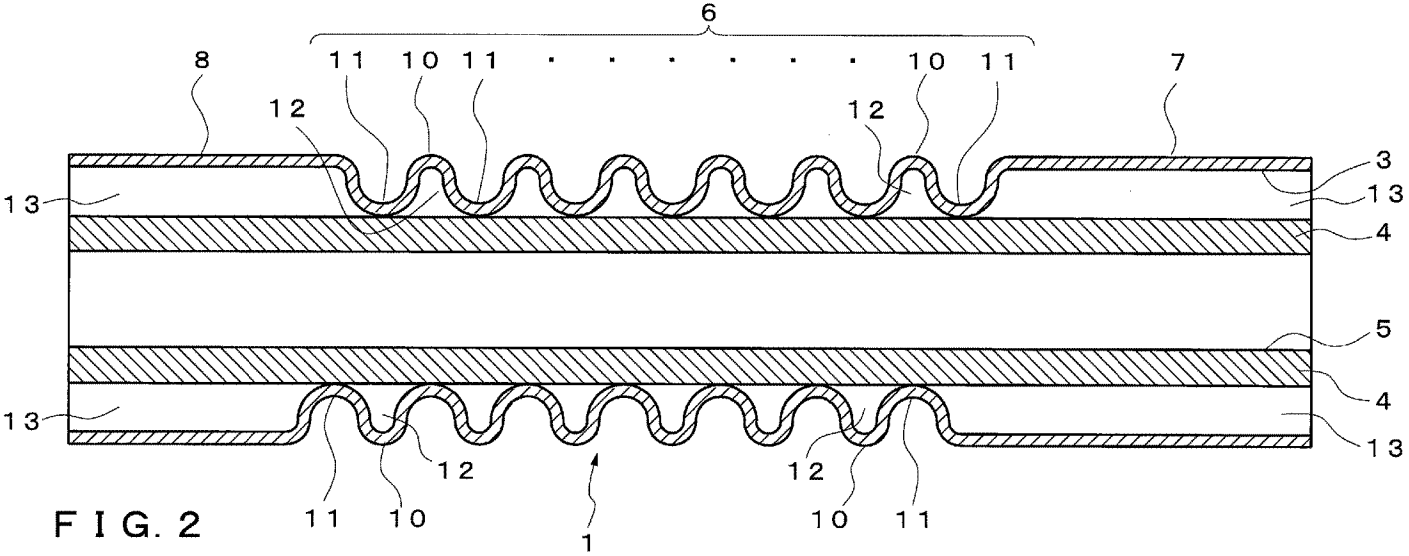
FIG. 2 is a side cross sectional view showing a heat pipe according to the first embodiment of the present disclosure.

Further features of the present disclosure will become apparent from the following detailed description of exemplary embodiments with reference to the accompanying drawings. A heat pipe according to a first embodiment of the present disclosure will be described below with reference to the drawings. As shown in FIGS. 1 and 2, a heat pipe 1 according to the first embodiment has a container 2 formed of a sealed tube, a radial direction cross section thereof being circular, a wick structure 4 that is installed in contact with an inner peripheral surface of a hollow portion 3 inside the container 2 and that produces a capillary force, and a working fluid (not shown) enclosed in the hollow portion 3. A corrugated portion 6 having a helical shape is formed in a peripheral direction wall surface of the container 2 at a central part in a longitudinal direction of the container 2 in a direction parallel to the longitudinal direction of the container 2 with a major axis of the container 2 being a center axis. Also, the wick structure 4 is provided with a vapor channel 5 which is a through-hole linearly penetrating inside the wick structure 4 in a longitudinal direction of the hollow portion 3.

As for the heat pipe 1, the corrugated portion 6 having a helical shape is not formed at the two end portions of the container 2, and an inner peripheral surface and an outer peripheral surface of the container 2 are both smooth. Of the two end portions of the container 2, one end portion is a heat input side end portion 7 and the other end portion is a heat output side end portion 8. When the heat input side end portion 7 is thermally connected to a heating element which is an object to be cooled, the heat input side end portion 7 receives heat from the heating element. Further, the heat output side end portion 8 is cooled by attaching a heat exchanger unit (not shown) such as a heat dissipating fin or a heat sink to the heat output side end portion 8, or by directly exposing the heat output side end portion 8 in an external environment. By cooling the heat output side end portion 8, heat originating from a heating element and transported from the heat input side end portion 7 to the heat output side end portion 8 is released out of the heat pipe 1 from the heat output side end portion 8.

At the corrugated portion 6 having a helical shape, crest portions 10 and trough portions 11 are formed alternately and repeatedly in a direction parallel to the longitudinal direction of the container 2. Therefore, both the crest portions 10 and the trough portions 11 helically extend in the longitudinal direction of the container 2. The crest portion 10 protrudes, with respect to the trough portion 11, from an inner peripheral surface side to an outer peripheral surface side of the container 2 in a direction parallel to or a direction generally parallel to the radial direction of the container 2, and the trough portion 11 protrudes, with respect to the crest portion 10, from an outer peripheral surface side to an inner peripheral surface side of the container 2 in a direction parallel to or a direction generally parallel to the radial direction of the container 2.

As to the corrugated portion 6 having a helical shape, the width of the crest portion 10 is not particularly limited, and may be of a uniform width or an non-uniform width. Also, the width of the trough portion 11 is not particularly limited, and may be of a uniform width or an non-uniform width. Further, with the corrugated portion 6 having a helical shape, the height of the crest portion 10 and the depth of the trough portion 11 are both not particularly limited, and may be of a uniform size or a non-uniform size.

Figure 3:
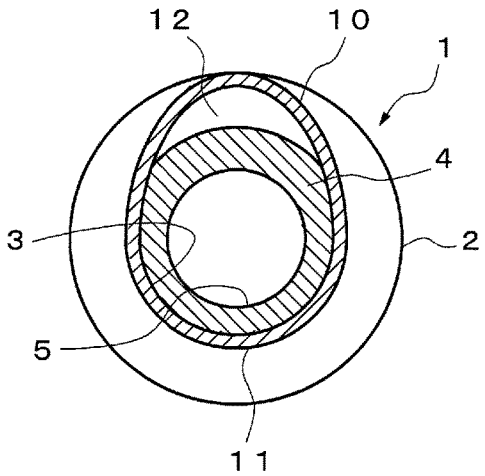
FIG. 3 is a cross sectional view of the heat pipe taken along A-A' in FIG. 1.

As shown in FIGS. 2 and 3, in the hollow portion 3, the wick structure 4 is provided from the heat input side end portion 7 to the heat output side end portion 8. The wick structure 4 is accommodated in the hollow portion 3 such that the wick structure 4 is in contact with the inner peripheral surface of the container 2, in other words, in contact with a peripheral surface of the hollow portion 3. In the heat pipe 1, since the corrugated portion 6 having a helical shape is formed in a direction parallel to the longitudinal direction of the container 2, the wick structure 4 is accommodated in the hollow portion 3 with a portion at a position of the peripheral surface of the hollow portion 3 corresponding to the trough portion 11 being in contact with an outer surface of the wick structure 4.

With the heat pipe 1, the shape of the wick structure 4 is cylindrical. Also, as described above, the outer surface of the wick structure 4 is in contact with the trough portion 11. Therefore, a gap portion 12 is formed between the outer surface of the wick structure 4 and the crest portion 10 of the corrugated portion 6 having a helical shape. That is to say, an inner space of the crest portion 10 is the gap portion 12. Since the crest portion 10 and the trough portion 11 are both formed in a helical manner in a longitudinal direction of the container 2, the gap portion 12 also extends in a helical manner in a longitudinal direction of the hollow portion 3.

Also, as shown in FIG. 2, since the portion of at the position of the peripheral surface of the hollow portion 3 corresponding to the trough portion 11 is in contact with the outer surface of the wick structure 4, the peripheral surface of the hollow portion 3 and the outer surface of the wick structure 4 are not in contact with each other at both end portions of the container 2 where the corrugated portion 6 having a helical shape is not formed, and a space portion 13 is formed. The space portion 13 is in communication with the gap portion 12.

Further, the wick structure 4, which is cylindrical, is provided with a vapor channel 5 penetrating inside the wick structure 4 in a direction parallel to or a direction generally parallel to the longitudinal direction of the hollow portion 3. As shown in FIG. 3, a cross section of the vapor channel 5 in a direction parallel to the radial direction of the wick structure 4 is circular.

The vapor channel 5 of the wick structure 4 and the gap portion 12 formed between the outer surface of the wick structure 4 and the crest portion 10 of the corrugated portion 6 having a helical shape serve as a channel of the working fluid in a gas phase through which the working fluid vaporized at the heat input side end portion 7, which is one end portion of the heat pipe 1, flows from the heat input side end portion 7 to the heat output side end portion 8, which is the other end portion of the heat pipe 1, to thereby transport heat received from the heating element from the heat input side end portion 7 to the heat output side end portion 8. The working fluid in a gas phase transported from the heat input side end portion 7 to the heat output side end portion 8 releases latent heat at the heat output side end portion 8, condenses and turns into a working fluid in a liquid phase.

The wick structure 4 produces a predetermined capillary force. Therefore, the wick structure 4 causes the working fluid which has condensed at the heat output side end portion 8 to flow back from the heat output side end portion 8 to the heat input side end portion 7 by the capillary force. The capillary force of the wick structure 4 is adjustable by, for example, regulating a ratio of a volume of a space in which the wick material of the wick structure 4 does not exist to a volume occupied by the wick structure 4, namely porosity of the wick structure 4.

As to the heat pipe 1, the vapor channel 5 formed in the wick structure 4 and the gap portion 12 between the wick structure 4 and the crest portion 10 of the container 2 serve as a channel that through which the working fluid in a gas phase flows from the heat input side end portion 7 to the heat output side end portion 8, and the wick structure 4 allows the working fluid of the liquid phase to flow back from the heat output side end portion 8 to the heat input side end portion 7. Therefore, in the heat pipe 1, since the channels are clearly divided between the working fluid in a gas phase and the working fluid in a liquid phase that are opposite flows to each other, improved heat transportation efficiency is obtained. Also, as described above, the gap portion 12 between the wick structure 4 and the crest portion 10 of the container 2 is a channel of the working fluid in a gas phase, and an inflow of the working fluid into the gap portion 12 in the liquid phase is prevented by the presence of the wick structure 4 producing a capillary force. Therefore, since a gas phase is produced inside the crest portion 10, namely the gap portion 12, dissipation of heat from the crest portion 10 to an external environment of the heat pipe 1 is promoted, and a result, a cooling effect of the heat pipe 1 further improves.

The material of the container 2 may be, for example, copper, copper alloy, aluminum, aluminum alloy, or stainless steel, but should not be limited thereto. The material of the wick structure 4 may be a metal mesh, a carbon fiber or the like of copper, copper alloy, aluminum, aluminum alloy or stainless steel, but should not be limited thereto. The working fluid to be enclosed in an internal space of the container 2 can be selected as appropriate depending on suitability with the material of the container 2, and may be, for example, water, chlorofluorocarbon alternative, florinert, or cyclopentane.

An exemplary use of the heat pipe 1 according to the first embodiment of the present disclosure will now be described. For example, the use of the heat pipe 1 is not particularly limited, but the heat pipe 1 may cool an electronic component (heating element) mounted on a substrate placed in a narrow space. In this case, after applying necessary deformation such as bending or twisting to the heat pipe 1 at a portion where the corrugated portion 6 having a helical shape is provided depending on a condition of the space around the heating element or a position of the heating element, the heat input side end portion 7 is thermally connected to the electronic part on the substrate, and, the heat output side end portion 8 is cooled by the aforementioned heat exchanger unit, thus an electronic component placed in a narrow space and mounted on a substrate can be cooled.

An exemplary method of manufacturing of the heat pipe 1 according to the first embodiment of the present disclosure will be described. The method of manufacturing the heat pipe 1 is not particularly limited, and, for example, the heat pipe 1 may be manufactured by forming the wick structure 4 by inserting a sheet-shaped metal mesh curled up into a cylindrical shape into a pipe material provided with the corrugated portion 6 having a helical shape, thereafter injecting the working fluid into the pipe material, and thereafter sealing the pipe material to form the container 2. The corrugated portion 6 having a helical shape can be formed, for example, by inserting a core rod into a pipe material that form a material of the container 2, and thereafter plastically deforming a wall surface of the pipe material that becomes the material of the container 2 by a roller or the like.

The heat pipe according to the second embodiment of the present disclosure will described with reference to the drawings. Note that components that are the same as those of the heat pipe according to the first embodiment is will be described using the same reference numerals.

Figure 4:
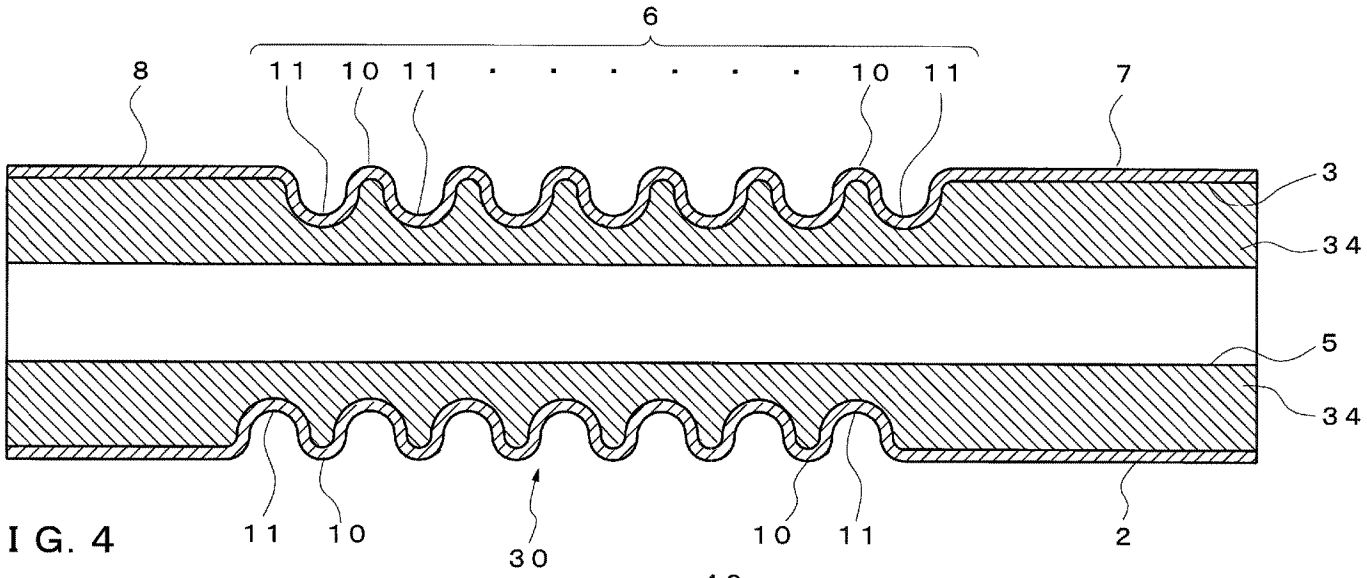
FIG. 4 is a side cross sectional view showing a heat pipe according to a second embodiment of the present disclosure.

As shown in FIG. 4, with a heat pipe 30 according to the second embodiment of the present disclosure, a wick structure 34 producing a capillary force is also provided at a region inside the crest portion 10 of the corrugated portion 6 having a helical shape. In FIG. 4, the region having a crest portion 10 is filled with the wick structure 34. As to the heat pipe 30, the wick structure 34 is in contact with an entirety of a peripheral surface of the hollow portion 3. That is to say, the wick structure 34 is accommodated in the hollow portion 3 with a portion of the hollow portion 3 not only at a position of the trough portion 11 of the corrugated portion 6 having a helical shape of the hollow portion 3, but also at a position of the crest portion 10, a position of the heat input side end portion 7 where the corrugated portion 6 having a helical shape is not formed, and a position of the heat output side end portion 8 where the corrugated portion 6 having a helical shape is not formed being in contact with and an outer surface of the wick structure 34. Therefore, in the heat pipe 30, portions corresponding to the gap portion 12 and the space portion 13 of the heat pipe 1 are not formed.

As described above, as shown in FIG. 4, each of the thickness of the wick structure 34 at the position of the crest portion 10 and the thicknesses at the positions of the heat input side end portion 7 and the heat output side end portion 8 where the corrugated portion 6 having a helical shape is not formed is greater than the thickness of the wick structure 34 at the position of the trough portion 11 by a size of the depth of the trough portion 11.

The wick structure 34 is provided with the vapor channel 5 linearly penetrating through the wick structure 34 in a direction parallel to or in a direction generally parallel to the longitudinal direction of the hollow portion 3. Also, a cross section of the vapor channel 5 in a direction parallel to a radial direction of the wick structure 34 is circular.

Since the wick structure 34 is also provided in the crest portion 10 of the corrugated portion 6 having a helical shape, and in contact with an entire peripheral surface of the hollow portion 3, the capillary force of the wick structure 34 is increased in the heat pipe 30, and further, with the corrugated portion 6 having a helical shape, since the surface area is increased as compared to a container with only a smooth surface, a heat dissipation effect also increases.

As to the heat pipe 30, the region in the crest portion 10 is filled with the wick structure 34, but there may be a case in which a void portion (not shown in FIG. 4) exists in the wick structure 34 located at a region in the crest portion 10 of the corrugated portion 6 having a helical shape (i.e., a void portion is formed during manufacture). The void portion is formed inside the wick structure 34 or between the wick structure 34 and an inner surface of the crest portion 10. In a case where the void portion is formed, with the wick structure 34 being also formed in the crest portion 10, since an inside of the void portion is in a gas phase while a capillary force further improves, the void portion has a similar function as the gap portion 12 of the heat pipe 1, the crest portion 10 of the corrugated portion 6 having a helical shape has an improved heat production ability.

Figure 7A:
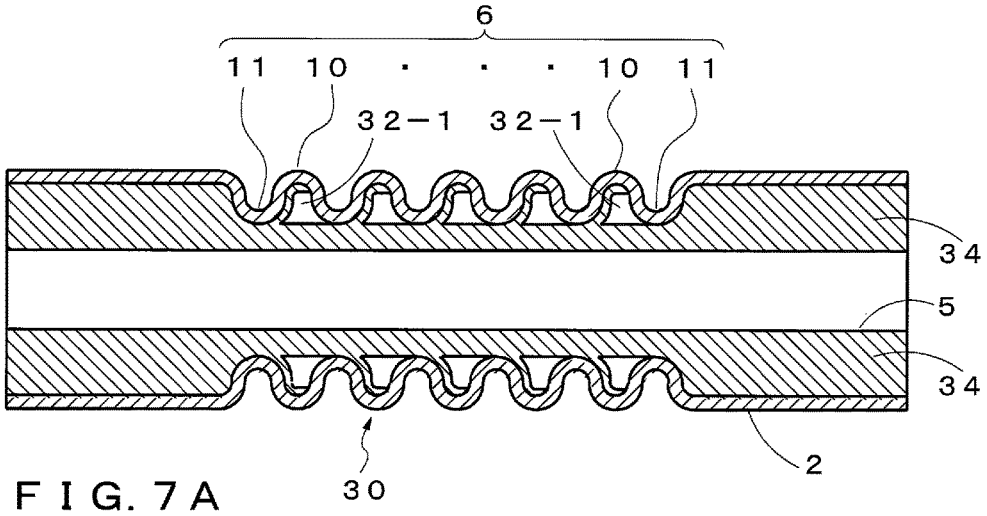
FIG. 7A is an explanatory diagram of a void portion of a wick structure of the heat pipe according to the second embodiment of the present disclosure.
Figure 7B:
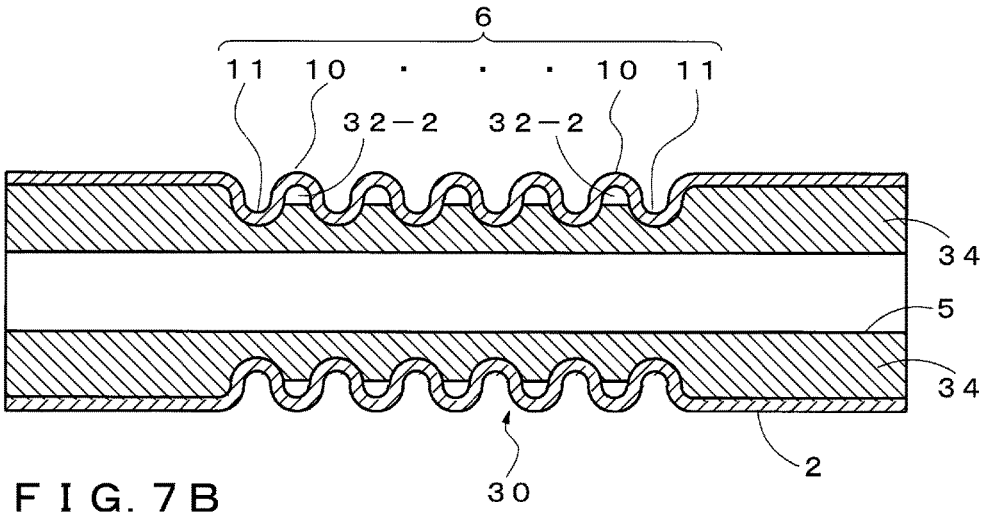
FIG. 7B is another explanatory diagram of a void portion of a wick structure of the heat pipe according to the second embodiment of the present disclosure.

Specific exemplary embodiments of abovementioned void portion formed inside the wick structure 34 or between the wick structure 34 and the inner surface of the crest portion 10 will be described below with reference to FIGS. 7A and 7B. The void portion may be an inside gap portion 32-1 shown in FIG. 7A, in which the wick structure 34 is provided along a peak portion and one of the side portions of the crest portion 10, namely the wick structure 34 is not provided at the central portion of the inner space of the crest portion 10 and the other of the side portions of the crest portion 10 and forming a gap portion, or a top gap portion 32-2 shown in FIG. 7B, in which the wick structure 34 is provided from a middle portion to the bottom portion of the crest portion 10, namely, the wick structure 34 is not provided at the top portion of the crest portion 10 and forms a gap portion.

The material of the wick structure 34 may be a sintered body of a metal material in a powdered form (e.g., nano-particles) such as copper, copper alloy, aluminum, aluminum alloy, and stainless steel, or carbon power, but not particularly limited thereto.

An exemplary method of manufacturing the heat pipe 30 according to the second embodiment of the present disclosure will now be described. A method of manufacturing heat pipe 30 is not particularly limited, and for example, the wick structure 34 that is a sintered body of the metal material is formed by inserting a core rod into a pipe material provided with the corrugated portion 6 having a helical shape and filling powdered metal material in a gap formed between an internal wall surface of the pipe material and a core rod, and thereafter performing a heating process. After the heating process, the core rod is withdrawn from the pipe material and the working fluid is injected in the pipe material, and the pipe material is sealed to form the container 2. Thus, the heat pipe 30 can be manufactured. In this manner, by forming a corrugated portion in the pipe material and thereafter filling the metal powder and forming a sintered body, a heat pipe structure is obtained in which the metal powder is also filled in the corrugated portion and the wick structure is projected into the crest portion of the corrugated portion. Also, by first forming the corrugated portion in the pipe material, filling in the metal powder and forming the sintered body, it is possible to prevent cracks or peelings of the sintered body in a case where the corrugated portion is formed after having filled in the metal particles and formed the sintered body.

Next, the heat pipe according to the third embodiment of the present disclosure will be described with reference to the drawings. Constituent elements that are the same to those of the heat pipe according to the first embodiment will be described using the same reference numerals.

Figure 5B:
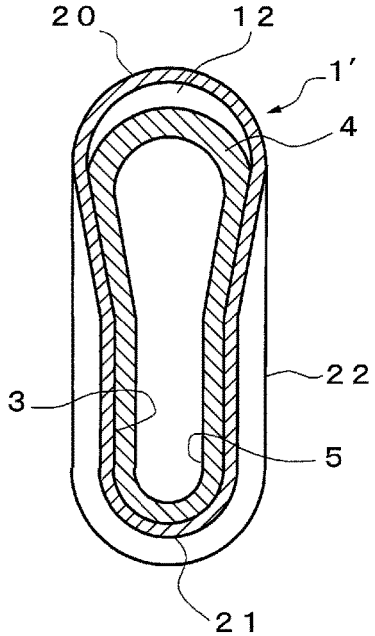
FIG. 5B is a cross sectional view of the heat pipe taken along B-B' in FIG. 5A.

As shown in FIG. 5B, a heat pipe 1' according to the third embodiment includes a container 22 subjected to a flattening process, in place of the container 2 having a circular cross section in the radial direction that is included in the heat pipe 1 according to the first embodiment. That is, with a flattening process being applied to a circular pipe material, a cross section in a direction parallel to the radial direction of the container 22 has a shape having flat portions opposing each other and curved portions opposing each other. A flattening process is applied to the heat pipe 1' from the heat input side end portion (not shown) to the heat output side end portion (not shown) including a corrugated portion 26 having a helical shape formed at the central part in the longitudinal direction of the heat pipe 1'. Also, depending on the flattening process, the wick structure 4 contained inside the container 22 is also deformed into a flattened shape.

Figure 5A:
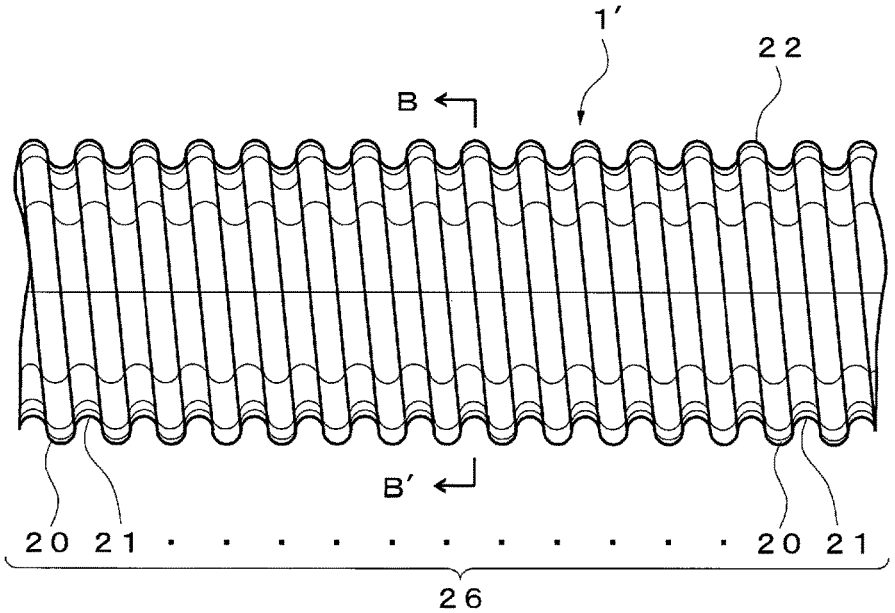
FIG. 5A is a partial side elevation showing a heat pipe according to a third embodiment of the present disclosure.

As shown in FIG. 5A, similarly to the heat pipe 1 according to the first embodiment, the corrugated portion 26 having a helical shape of the heat pipe 1' has crest portions 20 and trough portions 21 formed alternately and repeatedly in a direction parallel to the longitudinal direction of the container 22.

Also, as shown in FIG. 5B, similarly to the heat pipe 1 according to the first embodiment, the wick structure 4 of the heat pipe 1' is provided with the vapor channel 5 which is a through hole penetrating through the wick structure 4. In accordance with the wick structure 4 deformed in a flattened manner, a cross section of the vapor channel 5 in a direction parallel to the radial direction of the wick structure 4 also has a shape having substantially flat portions opposing each other and bent portions opposing each other.

Further, similarly to the heat pipe 1 according to the first embodiment, in the heat pipe 1', an outer surface of the wick structure 4 is in contact with the trough portion 21. Thus, the gap portion 12 is formed between the outer surface of the wick structure 4 and the crest portion 20 of the corrugated portion 26 in a helical shape.

With the heat pipe 1', since a flattening process is applied to the container 22 and flattened portions are formed, a thermal connectivity with the heating element further improves, and a cooling capacity of the heat pipe further increases. Further, with the flattening process described above, the height of the heat pipe 1' is decreased and thus the heat pipe 1' can be arranged in a smaller space such as avoid. Further, by applying a flattening process to the heat input side end portion and the heat output side end portion, it is possible to increase a contact area with the heating element at the heat input portion and to reduce a pressure loss of cooling air at the heat output portion.

A heat pipe according to the fourth embodiment of the present disclosure will now be described with reference to the drawings. Note that components that are the same as those of the heat pipe according to the aforementioned embodiments will be described using the same reference numerals.

Figure 6:
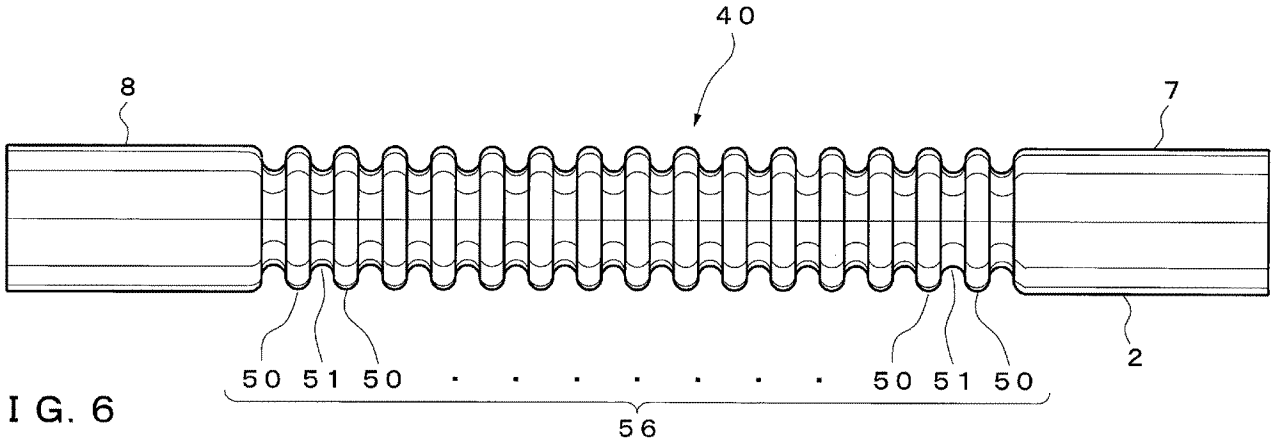
FIG. 6 is a side view showing a heat pipe according to a fourth embodiment of the present disclosure.

As shown in FIG. 6, in place of the corrugated portions 6 and 26 having a helical shape, a heat pipe 40 according to the fourth embodiment has a corrugated portion 56 which does not have a helical shape is formed in a container. The heat pipe 40 according to the fourth embodiment is provided with a plurality of crest portions 50 of the corrugated portion 56 which does not have a helical shape, and the crest portions 50 are formed coaxially with a longitudinal axis of the container 2 being a center axis. Also, a plurality of trough portions 51 are formed, and the trough portions 51 are formed coaxially with a longitudinal axis of the container 2 being a center axis. That is, each of the crest portions 50 of the corrugated portion 56 which does not have a helical shape has a structure in which a top portion thereof faces a direction parallel to or substantially parallel to (in a parallel direction in FIG. 6) the a radial direction of the container 2. Also, each of the trough portions 51 of the corrugated portion 56 which does not have a helical shape has a structure in which a bottom portion thereof faces a direction parallel to or substantially parallel to (in a parallel direction in FIG. 6) the a radial direction of the container 2.

The corrugated portion 56 can also give a property of easily undergoing deformation such as bending and twisting and maintaining the deformed shape to the heat pipe 40. It is to be noted that, the heat pipe 40 may also have the wick structure of a metal mesh or a sintered body of metal material.

Other embodiments of the present disclosure will now be described. With each of the embodiments described above, the corrugated portion having a helical shape was formed at the central part of the heat pipe, and the corrugated portion having a helical shape was not formed at the heat input side end portion and the heat output side end portion. Alternatively, the corrugated portion having a helical shape may be formed not only at the central part of the heat pipe but also at the heat input side end portion and/or heat output side end portion, and, the corrugated portion having a helical shape may be formed not only at a single place but also at a plurality of places at the central part of the heat pipe. Also, the corrugated portion having a helical shape may be formed on the entire surface of the heat pipe. Also, with the heat pipe according to the third embodiment, a flattening process was applied to an entire surface of the heat pipe. Alternatively, a flattening process may be applied to the heat input side end portion and/or heat output side end portion, and even an embodiment in which a flattening process is not applied to the corrugated portion having a helical shape may be employed.

The heat pipe 1' according to the third embodiment has structure in which a flattening process was applied to the container of the heat pipe 1 according to the first embodiment. Alternatively, even an embodiment in which a flattening process was applied to a container of heat pipe 30 according to the second embodiment may be employed. Also, the shape of the corrugated portion is not particularly limited, and may be a helical shape or a shape in which a plurality of crest portions and trough portions are placed concentrically as described above, and in addition, for example, may be a configuration in which a plurality of trough portions and a plurality of crest portions are formed and the top portion of each crest portion and the bottom portion of each trough portion are not opposed.

Figure 8A:
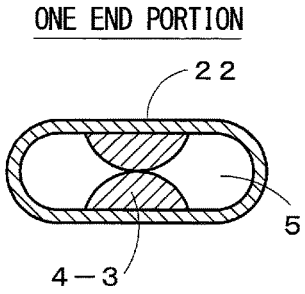
FIG. 8A to 8C are explanatory diagrams of cross sectional shapes of a wick structure of a heat pipe according to another embodiment of the present disclosure.
Figure 8B:
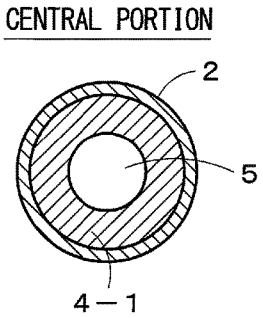
Figure 8C:
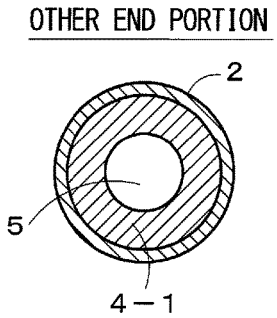
Figure 9A:
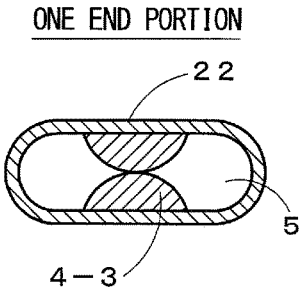
FIG. 9A to 9C are explanatory diagrams of cross sectional shapes of a wick structure of a heat pipe according to another embodiment of the present disclosure.
Figure 9B:
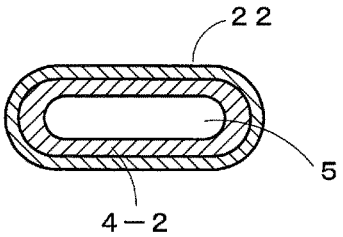
Figure 9C:
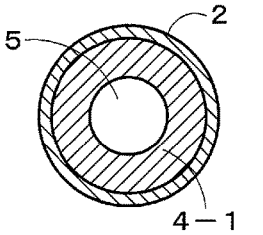
Figure 10A:
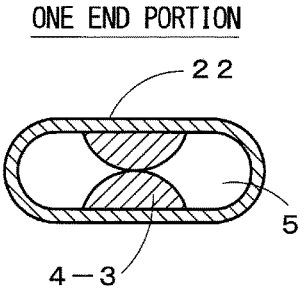
FIG. 10A to 10C are explanatory diagrams of cross sectional shapes of a wick structure of a heat pipe according to another embodiment of the present disclosure.
Figure 10B:
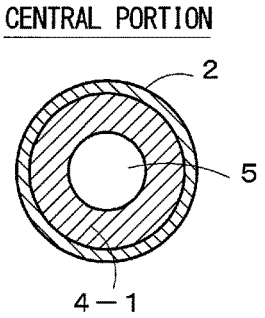
Figure 10C:
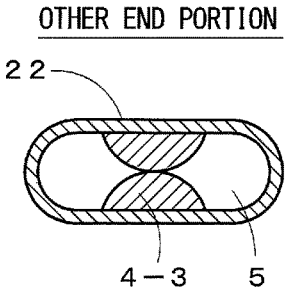
Figure 11A:
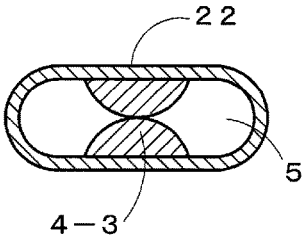
FIG. 11A to 11C are explanatory diagrams of cross sectional shapes of a wick structure of a heat pipe according to another embodiment of the present disclosure.
Figure 11B:
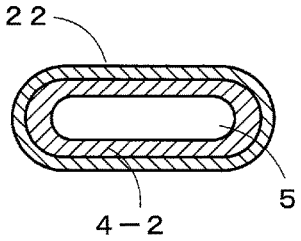
Figure 11C:
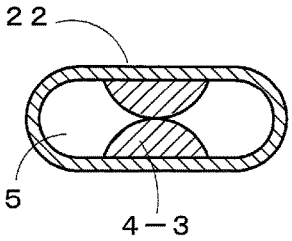
Figure 12A:
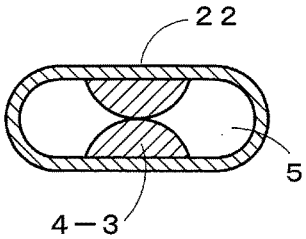
FIG. 12A to 12C are explanatory diagrams of cross sectional shapes of a wick structure of a heat pipe according to another embodiment of the present disclosure.
Figure 12B:
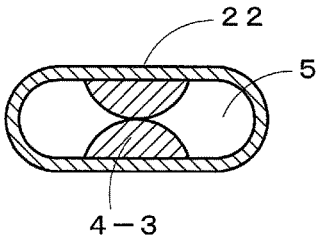
Figure 12C:
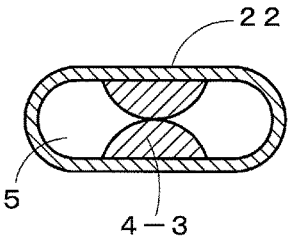
Figure 13A:
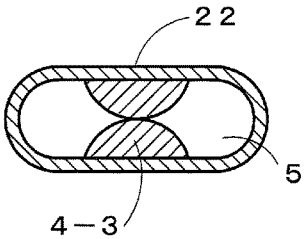
FIG. 13A to 13C are explanatory diagrams of cross sectional shapes of a wick structure of a heat pipe according to another embodiment of the present disclosure.
Figure 13B:
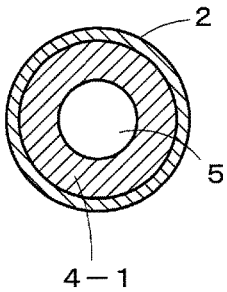
Figure 13C:
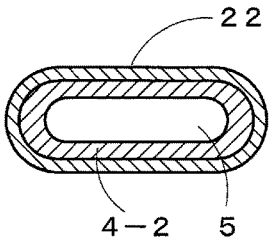

Also, with each of the embodiments described above, a cross sectional shape of the wick structure in the radial direction of the container was circular or a flattened shape both end portions and the central portion of the container. Alternatively, as shown in FIGS. 12A to 12C, the wick structure may be a semi-circular wick structure 4-3 having a cross sectional shape in which two substantially semi-circular shapes are in contact with each other at top portions in the container 22 that has been subjected to a flattening process. Also, as shown in FIGS. 8A to 8C, one end portion may be of a semi-circular wick structure 4-3 and the central portion and the other end portion may be of a circular wick structure 4-1 in which the wick structure has a circular ross sectional shape in the container 2 in which a cross sectional shape in the radial direction is circular. As shown FIGS. 9A to 9C, one end portion may be of a semi-circular wick structure 4-3, the central part may be a flattened wick structure 4-2 in which the wick structure has a flattened cross sectional shape in the container 22 that has been subjected to a flattening process, and the other end may be of a circular wick structure 4-1. As shown in FIGS. 10A to 10C, both end portions may be of a semi-circular wick structure 4-3 and the central portion may be of a circular wick structure 4-1. As shown in FIGS. 11A to 11C, both end portions may be of a semi-circular wick structure 4-3 and the central portion may be of a flattened wick structure 4-2. As shown in FIGS. 13A to 13C, one end portion may be of a semi-circular wick structure 4-3, the central portion may be of a circular wick structure 4-1, and the other end portion may be of a flattened wick structure 4-2. It is to be noted that the cross-sectional shape of the aforementioned wick structure at one end portion, the other end portion and the central portion may either be a portion where the corrugated portion is formed or a portion where the corrugated portion is not formed.

Figure 14:
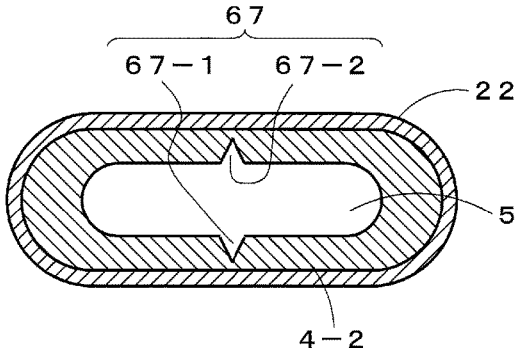
FIG. 14 is an explanatory diagram of a cross sectional shape of a wick structure of a heat pipe according to another embodiment of the present disclosure.

As shown in FIG. 14, it is to be noted that a flattened wick structure 4-2 may be provided with a recessed groove 67. In FIG. 14, opposing flattened portions are provided with recessed grooves 67-1 and 67-2, respectively. As to the two recessed grooves 67, a recessed groove 67-1 on a gravity direction side contributes to retention of the working fluid and prevents drying out, and a recessed groove 67-2 at a side opposite to the gravity direction serves as an extended portion of the vapor channel 5.

Also, with each of the aforementioned embodiments, the wick structure produces the same capillary force at each portion. Alternatively, the wick structure may produce different capillary forces depending on the portion. For example, it may be a wick structure producing a capillary force which are different at the corrugated portion and the neighborhood thereof and portions other than these, or wick structures producing different capillary forces may be laminated.

Figure 15:
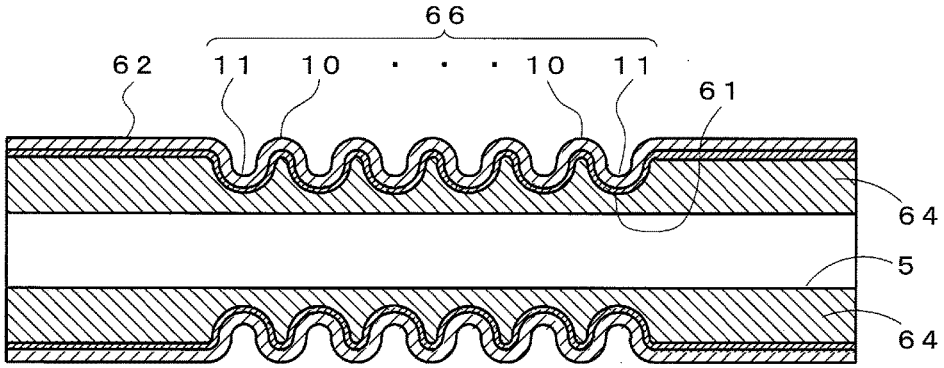
FIG. 15 is an explanatory diagram of a reinforcing member of a corrugated portion of a heat pipe according to another embodiment of the present disclosure.
Figure 16:
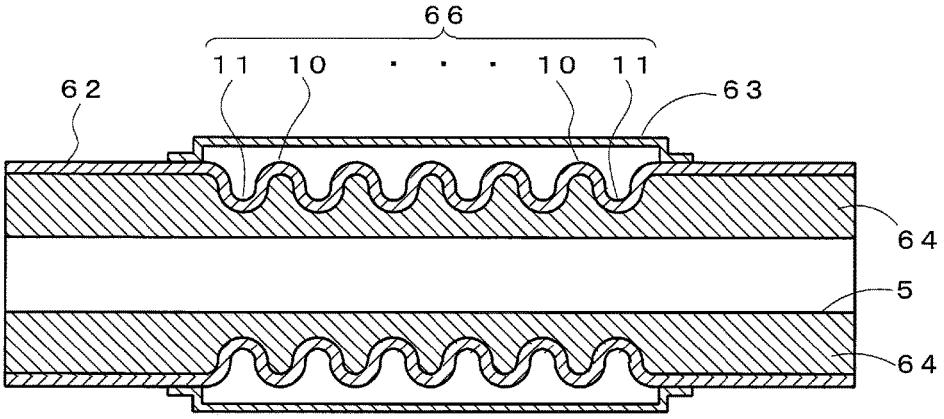
FIG. 16 is an explanatory diagram of a reinforcing member of a corrugated portion of the heat pipe according to another embodiment of the present disclosure.

Also, as shown in FIG. 15, in order to increase the strength of the corrugated portion 66 having a helical shape of the container 62 as needed, and to prevent a collapsing of the wick structure 64 due to bending and twisting of the corrugated portion 66 having a helical shape, a corrugated reinforcing member 61 have a wall surface portion corresponding to the shape of the corrugated portion 66 having a helical shape may be provided between an inner surface of the corrugated portion 66 having a helical shape and an outer surface of the wick structure 64. Also, as shown in FIG. 16, in order to increase the strength of the corrugated portion 66 having a helical shape of the container 62 as needed, a tube-shaped reinforcing member 63 having an internal surface corresponding to the shape of the corrugated portion 66 having a helical shape may be provided at an outer surface of the corrugated portion 66 having a helical shape. The material of the corrugated reinforcing member 61 and the tube-shaped reinforcing member 63 may be, for example, copper, copper alloy, aluminum, aluminum alloy, or stainless steel.

Figure 17:
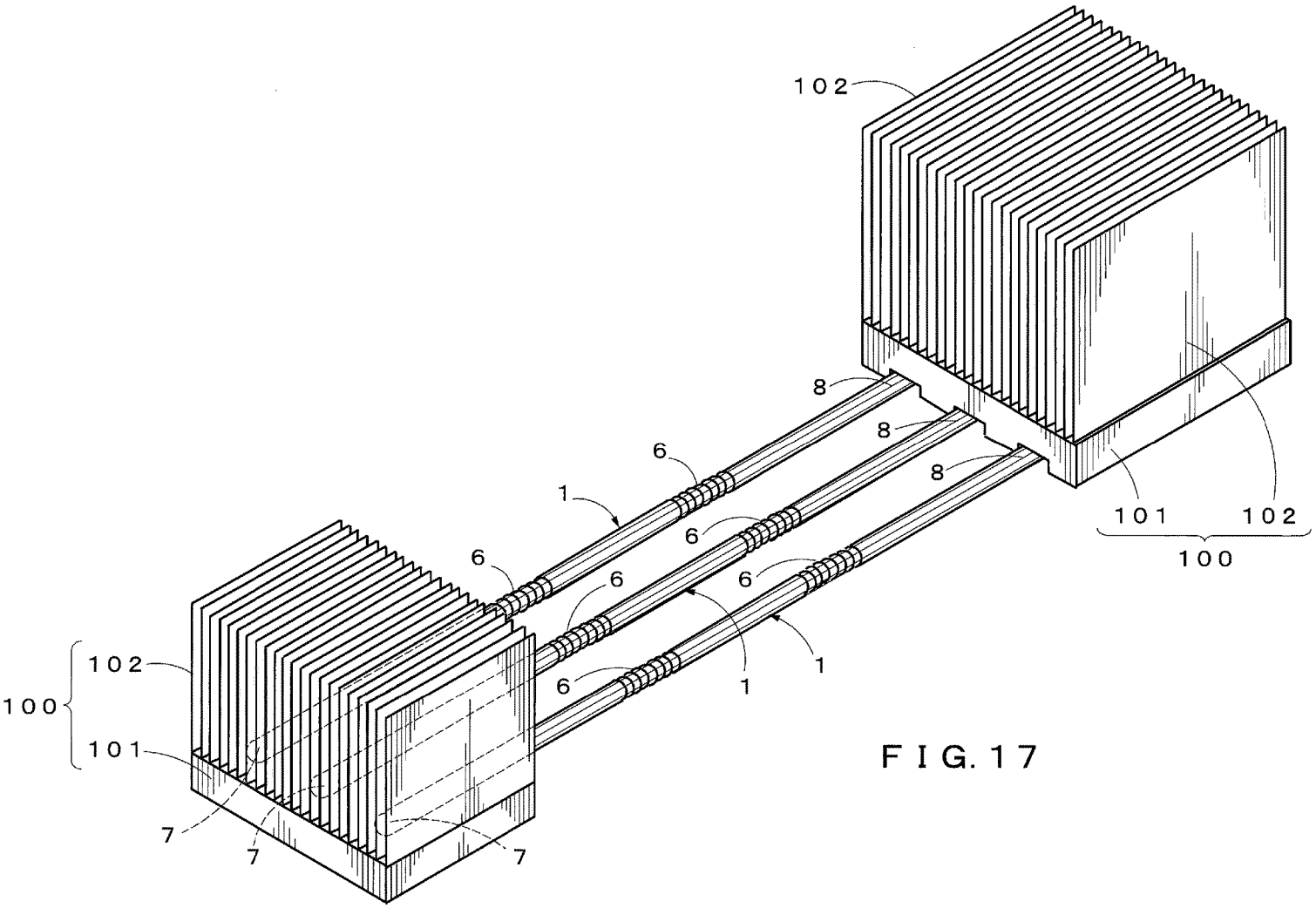
FIG. 17 is an explanatory diagram of a first specific usage example of the heat pipe of the present disclosure.

A specific exemplary use of the heat pipe according to the present disclosure will now be described. First, an example (first specific exemplary use) in a case where the heat pipe of the present disclosure is used as a heat sink will be described. As shown in FIG. 17, the heat output side end portion 8 of the heat pipe of the present disclosure (in FIG. 17, as an example, the heat pipe 1 according to the first embodiment (note that the corrugated portion 6 having a helical shape is provided at two places at the central part of each heat pipe 1)) is thermally connected to a heat sink 100 having a heat receiving plate 101 and a plurality of heat dissipating fins 102 provided to stand on a surface of the heat receiving plate 101. By thermally connecting the heat input side end portion 7 to an object to be cooled, not shown, the heat pipe 1 can transport heat transport from an object to be cooled to the heat sink 100 that is thermally connected to the heat output side end portion 8. In FIG. 17, in order to further positively cool an object to be cooled, the heat sink 100 having the heat receiving plate 101 and the plurality of heat dissipating fins 102 provided to stand on the surface of the heat receiving plate 101 is also connected to the heat input side end portion 7. In FIG. 17, each of a plurality of heat pipes 1 (three heat pipes) are thermally connected to the heat receiving plate 101 of heat sink 100. A method of thermally connecting the heat pipe 1 to the heat receiving plate 101 is not particularly limited. For example, the heat pipe may be secured to the heat receiving plate 101 by being screwed together connected thermally, by providing a corrugated portion having a helical shape also at the heat output side end portion 8, and providing a groove portion on a lateral face portion of the heat receiving plate 101 that can be screwed with the corrugated portion having a helical shape provided at the heat output side end portion 8.

Figure 18:
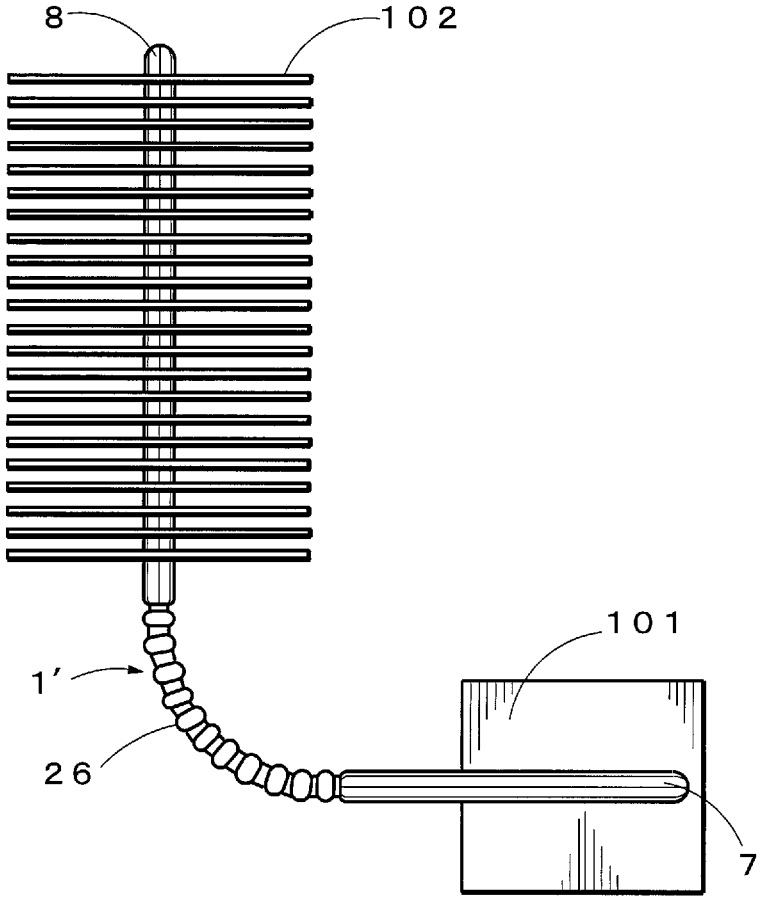
FIG. 18 is an explanatory diagram of a second specific usage example of the heat pipe of the present disclosure.

Also, as shown in FIG. 18, as a second specific exemplary use of the heat pipe of the present disclosure, the heat pipe of the present disclosure (in FIG. 18, the heat pipe 1' (the heat pipe, the entirety of which being subjected to a flattening process) according to the third embodiment as an example) is bent in an L-shape at the corrugated portion 26 having a helical shape, and making the heat output side end portion 8 to come into contact with the heat dissipating fin 102 to thermally connect the heat output side end portion 8 with the heat dissipating fin 102 and thermally connect the heat input side end portion 7 to the heat receiving plate 101 thermally connected to an object to be cooled (not shown).

Figure 19:
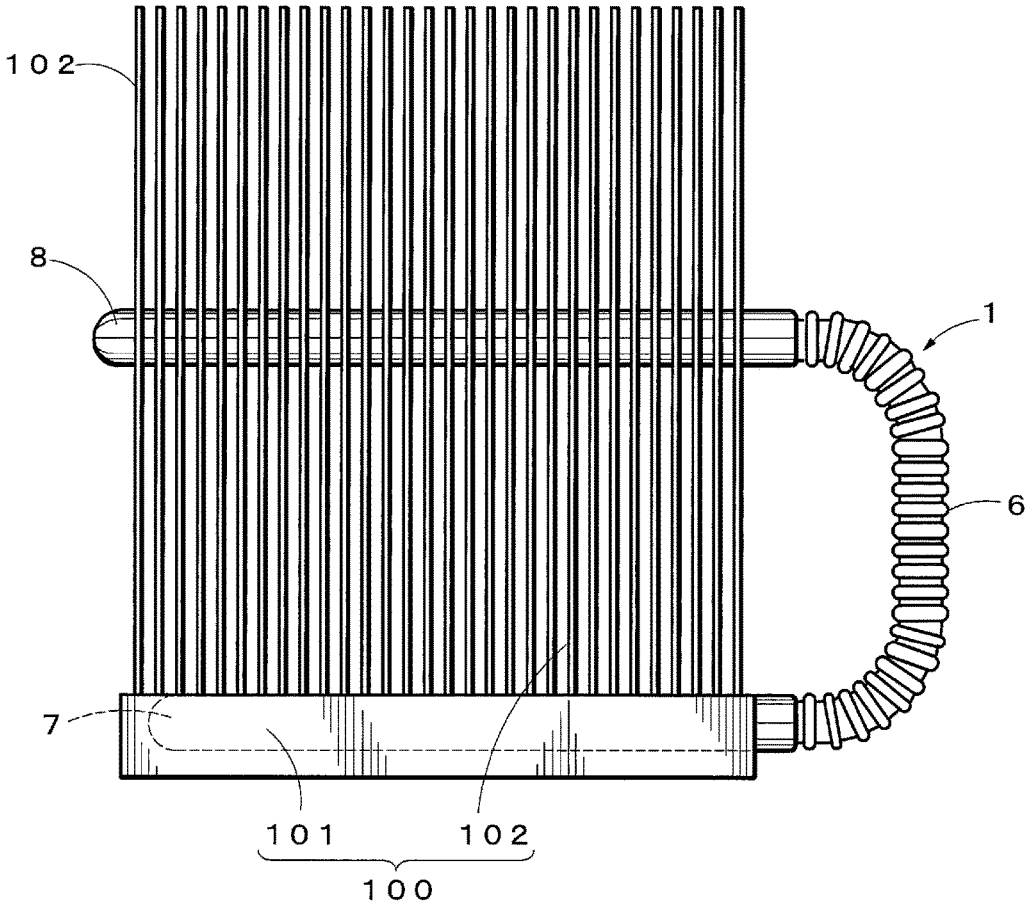
FIG. 19 is an explanatory diagram of a third specific usage example of the heat pipe of the present disclosure.

Also, as shown in FIG. 19, as a third specific exemplary use of the heat pipe of the present disclosure, the heat pipe of the present disclosure (in FIG. 19, the heat pipe 1 according to the first embodiment as an example) is bent into a U-shape at the corrugated portion 2 having a helical shape, and, as to the heat sink 100 having the heat receiving plate 101 and the plurality of heat dissipating fins 102 provided to stand on the surface of the heat receiving plate 101, thermally connecting the heat output side end portion 8 of the heat pipe 1 to the heat dissipating fin 102, and thermally connecting the heat input side end portion 7 to the heat receiving plate 101 that is thermally connected to an object to be cooled, not shown.

In this manner, by bending a heat pipe of the present disclosure at the corrugated portion having a helical shape, an object to be cooled can be cooled with using a heat pipe of the present disclosure even if placed in the small space.

The heat pipe 1 thermally connected to the heat sink 100 has a cross section in a radial direction that is circular, namely a cross section in the radial direction of the heat input side end portion 7 and the heat output side end portion 8 is circular. Alternatively, a heat pipe may be used in which a cross section in the radial direction of the heat input side end portion 7 and/or the heat output side end portion 8 is flattened.

The heat pipe of the present disclosure is useful in the field of cooling a heating element placed in a small space, since it has both a property of easily undergoing deformation such as bending and twisting and maintaining the deformed shape as well as an improved heat transportation capability.

What is claimed is:

1. A heat pipe comprising:

a container in which a corrugated portion is formed, the container having a hollow portion formed therein that is sealed;

a wick structure provided on an inner peripheral surface of the hollow portion, the wick structure having a vapor channel penetrating therethrough in a longitudinal direction of the hollow portion, the wick structure producing a capillary force, the wick structure being a sintered body of a powder metal material and being projected into a crest portion of the corrugated portion, the wick structure being accommodated in the hollow portion with a portion of the hollow portion at a region in the crest portion of the corrugated portion, at a position of a trough portion of the corrugated portion, at a position of the heat input side end portion where the corrugated portion is not formed, and at a position of the heat output side end portion where the corrugated portion is not formed being in contact with an outer surface of the wick structure, the thickness of the wick structure at the position of the crest portion, the thickness at the position of the heat input side end portion where the corrugated portion is not formed and the thickness at the position of the heat output side end portion where the corrugated portion is not formed is greater than the thickness of the wick structure at the position of the trough portion by a size of the depth of the trough portion, and a working fluid enclosed in the hollow portion.

2. The heat pipe according to claim 1, wherein a flattening process is applied to the container at a part or an entirety thereof in a longitudinal direction.

3. The heat pipe according to claim 1, wherein the corrugated portion is formed in the container at a part or an entirety thereof in a longitudinal direction.

4. The heat pipe according to claim 1, wherein the corrugated portion has a helical shape.

5. The heat pipe according to claim 1, wherein a void portion is formed in the wick structure in the crest portion.

* * * * *